US005096202A

United States Patent [19]

Hesland

[11] Patent Number: 5,096,202

[45] Date of Patent: Mar. 17, 1992

[54] DISPLAY SYSTEM FOR DATA ASSISTED BINGO GAME

[75] Inventor: Egil Hesland, Oslo, Norway

[73] Assignee: Egil Hesland A/S, Oslo, Norway

[21] Appl. No.: 543,812

[22] PCT Filed: Jan. 25, 1989

[86] PCT No.: PCT/NO89/00008

§ 371 Date: Jul. 26, 1990

§ 102(e) Date: Jul. 26, 1990

[87] PCT Pub. No.: WO89/06998

PCT Pub. Date: Aug. 10, 1989

[51] Int. Cl.[5] ..... A63F 3/06

[52] U.S. Cl. ..... 273/237; 273/269

[58] Field of Search ..... 273/269, 85 G, 237

[56] References Cited

U.S. PATENT DOCUMENTS 4,747,600 5/1988 Richardson ..... 273/269
4,848,771 7/1989 Richardson ..... 273/269 X
4,875,686 10/1989 Timms ..... 273/269 X

FOREIGN PATENT DOCUMENTS

0214290A1 3/1987 European Pat. Off. .

*Primary Examiner*—William H. Grieb
*Attorney, Agent, or Firm*—Wenderoth, Lind & Ponack

[57] ABSTRACT

A bingo game computer system includes a central computer unit having a master monitor, a master keyboard, and a plurality of gam monitors coupled thereto. The game monitors are provided in one-to-one correspondents with a number of game participants. Each of the monitors includes a switch operable by the game participant for indicating to the central computer unit that a bingo result has been achieved. The central computer unit includes a random number generator which generates a game number which is displayed on the master monitor and the plurality of game monitors. Further, the central computer unit causes an indicator to be displayed in a game square of each displayed bingo array which corresponds to the game number generated by the random number generator.

10 Claims, 2 Drawing Sheets

DISPLAY SYSTEM FOR DATA ASSISTED BINGO GAME

The present invention relates to a display system for a data assisted bingo game, where each individual game participant has positioned in front of himself a computer controlled pictorial presentation of several bingo square arrays containing bingo numbers or symbols.

In the ordinarily known form of the game of bingo, the game participant buys a number of "bingo vouchers, pieces or boards" with arrays of squares containing bingo numbers. As random numbers are brought up by a game master and called out, the game participant himself must cross out or cover those numbers in the square nets which coincide with the number just called out, while the master notes or in some other manner records every number called out. When a bingo result is obtained, i.e. when a participant has crossed out a full row of numbers in the square array, the game managers must check the results.

Many people, and particulary elderly persons, will often have a problem in following the game properly, especially if they have a rather high number of vouchers/square arrays, and thereby they have a risk of missing bingo results achieved and thus losing prizes which rightfully should be theirs.

Special bingo boards have been constructed comprising shiftable lids to cover the individual bingo numbers in the square array. A board of this type only remedies the problems mentioned above to a small degree, since the operation of shifting the lid to a position over the bingo number takes about the same amount of time as crossing out the number with a pen in an ordinary square array.

Furthermore, the necessary check of the correct bingo result by the management remains, since every number in the complete row must be read and checked against the numbers called out. The game would gain a clear advantage if a faster number check after the game was possible.

In addition, a lot of time is spent buying bingo vouchers between the game rounds. A simplification of both the charge payments and the checking of numbers would reduce demands for personnel in the game management, and a greater part of the game time may be used for the game itself.

The main object of the present invention is to provide a manner of presenting a bingo game which will aid the game participants in comprehending and following the progress of the game, and to increase the probability of a game participant achieving his or hers possible rightful prize, and possibly also ensuring this completely.

It is also an object to make the game, charge payment, prize disbursement and number check more efficient.

These and other objects which will appear from the more detailed description of the invention, are achieved by constructing a display system of the type that appears from the subsequent patent claims.

Figure 1:
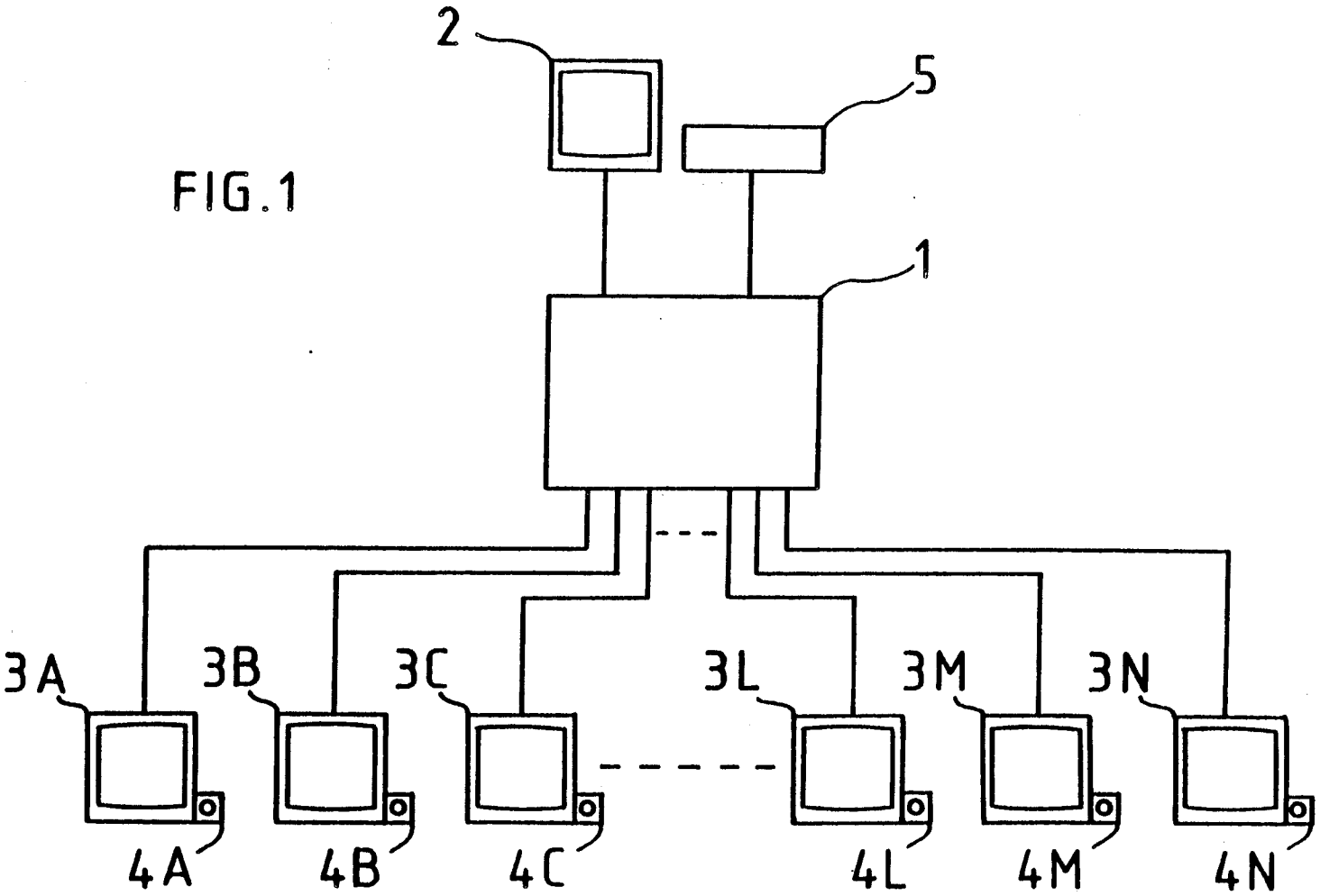
Figure 2:
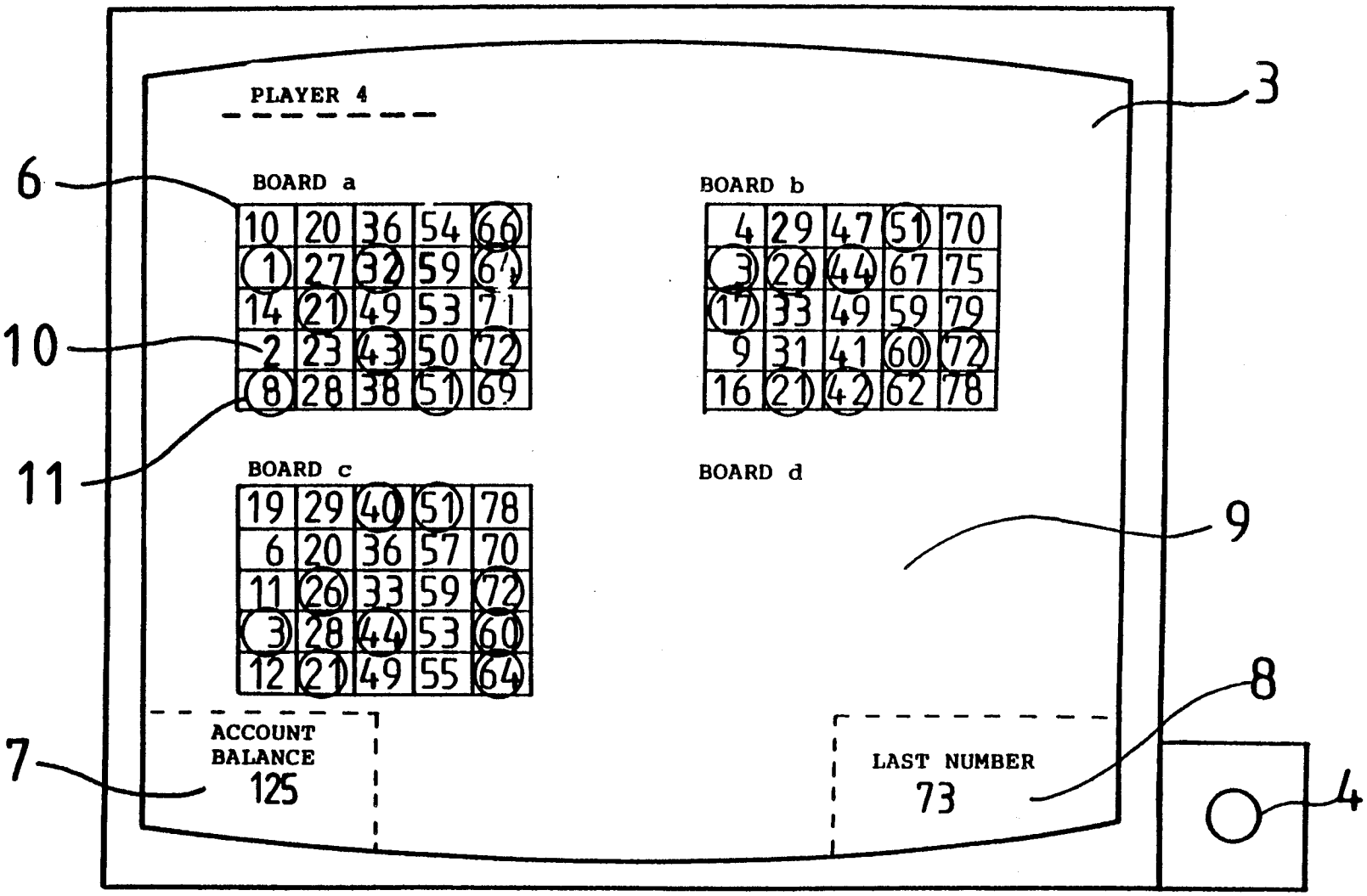

A more detailed description of the invention will be made referring to a preferred embodiment shown in the drawings, where FIG. 1 illustrates the apparatus set-up schematically, and FIG. 2 shows an example of a game monitor presentation in accordance with a preferred embodiment of the invention.

FIG. 1 shows a central computer 1 together with attached game monitors 3A, 3B, . . . , 3N. To each one of the game monitors is assigned a reaction push button 4A, 4B . . . , 4N to be operated by the individual game participant. The primary function of the reaction button is signalling to the computer 1 when a game participant discovers that a bingo result (for instance one complete row) has been achieved in his game monitor, and pushes the button. Other types of signalling from the button may be envisaged, for instance signalling certain simple data prior to the start of a game, given clearance from the game master, and having the form of a certain number of pushes of the button.

Furthermore, two devices are attached to the computer 1 in order to be used by the game master, namely a master monitor 2 and a master keyboard 5. By means of the master monitor and keyboard the game master is able to keep track of the progress of the game and retrieve desired information relating to the account balance of the participants. The central computer 1 is adapted and programmed to keep complete track of all movements in the game as well as the balance of each participant, and to generate the random numbers which constitute the essence of a bingo game. The computer also controls the monitor presentations and stores all necessary game information. The computer 1 therefore comprises several subprocessors. The random numbers are created in a random generator. An interface unit with a number N of parallell end-stages for the game monitors 3A–3N is necessary to provide correct video signals for each game monitor, and a special interface also exists for driving the master monitor 2. A picture control unit provides signals for the interfaces, and the picture control unit is governed by a central processor comprising arithmetic/logic units and necessary ROM and RAM type memory stores. The random generator, the master keyboard 5 and all of the reaction buttons 4A, . . . , 4N are connected to this central processor.

An examplified description of the progress of a game situation shall be used in the further elucidation of the present invention, alternatingly referring to both FIG. 1 and FIG. 2.

A number of game participants, at most equal to N, are seated by some of or all of the game monitors 3. The game participants pay the start charge for one or more game rounds to the game master, who enters start charge data for each particular participant (or game monitor) in the computer 1 by means of the master keyboard 5. The computer instantly presents the balance in a special field 7 (FIG. 2) of each game monitor 3. The game master then may ask orally, or the computer may display a written request to each game participant on his assigned game monitor, or possibly both at the same time, for a declaration of the desired number of bingo boards, i.e. bingo square arrays 6 in the first game, by pushing the reaction button 4 the desired number of times. The computer 1 immediately checks that the paid start charge is not exceeded, i.e. if the charge is insufficient for the desired number of bingo boards 6, and presents on the game monitor 3 the number of boards 6 which the game participant has selected, within the possible maximum which is four boards in the embodiment of FIG. 2.

As shown in FIG. 2, the player indicates a desire to play with three boards 6, wherefore "board d" is empty, see reference number 9. It is also possible to place more than four boards on one game monitor 3.

Simultaneously with the presentation of the boards 6, the balance of the game participant in field 7 is reduced in correspondance with the price of the chosen number of boards. The game master may now, by using the keyboard 5, retrieve as desired information about the account balance of each individual game monitor 3 on the master monitor 2.

Each of the bingo boards 6 now being displayed continuously and preferably in clear colours, if the game monitors 3 have colour capacity, contain bingo numbers 10 of ordinary type, or in certain embodiments of the invention special symbols/signs. When using a simpler version of the computer 1, the same number configuration will always be displayed in that bingo board 6 which takes up a certain position in the monitor picture of the individual game monitor 3, but when a more advanced version of the computer 1 is used, new bingo number configurations may very well be generated when starting a game and be maintained only during this game, generating new configurations for every new game, and preferably functions like these may be controlled by the game master using the keyboard 5.

The number of squares in a square array or board 6 on the game monitors 3 is not necessarily $5\times5=25$, as shown in the example of FIG. 2, but can be adapted to the prevailing circumstances, for instance the physical size of the monitors, readability and the like. It is also possible to let the game master make variations from one game to another concerning the size of the boards, by communicating with the computer 1 via the keyboard 5.

If it is desired, the prize of the game round in question may be presented on every game monitor 3, possibly in a particular field (not shown) in the monitor picture.

Then the game itself may begin. The game master now retrieves the first random integer from the random generator of the computer 1. Primarily the integer is presented instantaneously in a distinctive field 8 on each game monitor 3 as well as the master monitor 2, but at the same time an easily visible indication 11 is presented in those squares which contain the bingo number equal to the random integer, or containing the special symbol corresponding to the integer. In the example shown in FIG. 2, the indication has the shape of a ring 11 around the bingo number, but the indication may just as well be some other clearly visible symbol, or quite simply a distinct colour change in the square around the bingo number, which itself is maintained visible. The indication 11 is stored in the computer 1 and is maintained visible until the proceeding game ends. If it is desired, the indication 11 may possibly consist of blanking the bingo number in the square by entering a new colour to cover the square completely, for instance using black colour.

The computer 1 continues retrieving random integers, either on command from the game master via the keyboard 5, or automatically with predetermined time intervals, which time intervals possibly may be regulated by the game master. When an integer emerges to give one complete row in one of the boards 6 on one of the game monitors 3, a bingo result has been achieved. It is now presented on the master monitor 2 which game monitor (and possibly which board) has a bingo result. In this situation several possibilities exist, and all of these are covered by the present invention:

a) The computer 1 communicates no particular signal to the game monitors 3. Reaction by pushing the reaction button 4 is left completely to that game participant who has the bingo board in question, with one complete row. However, this is not the preferred embodiment, presenting higher demands on the power of apprehension and speed of the participant than that which is desirable.

b) The computer 1 blocks the further retrieval of random numbers, in such a manner that there is a pause. The duration of said pause may be predetermined or determined by the game master by using the keyboard 5. This embodiment gives the participant a better possibility of apprehending the situation, and more time for a reaction.

c) Same as b), but in addition the computer provides for, for instance by flashing or changing colour in a special field (not shown) or all over the picture background in the monitor picture of every game monitor 3, automatic information about the fact that a bingo result now is present. This is the most preferred embodiment, which ensures to a high degree that the game participant with a bingo result does not miss his complete row, but which still leaves final detection to the participant.

d) A solution which is similar to the preceding one, but in which the automatic information from the computer 1 about a bingo result is only presented on the game monitor of the lucky game participant, and in the same manner as stated in solution c), is also possible. However, this solution approaches the limit where no detection effort is necessary from the part of the participant, except from pushing the reaction button 4.

e) Of course the system offers the possibility that the computer quite simply informs on all game monitors 3 that a bingo result has occurred in for instance game monitor 3F and that the game consequently has come to an end. In this case it is not necessary to push the button. This is the limiting case as mentioned above, and it is usually not of great interest. However, this variant may be of particular interest when the participants in some way or another are handicapped, for instance people who are ill in beds. The game will have more the character of a pure lottery than in the other cases, but may still present a great entertainment value. The reaction buttons 4 may also be left out if the system in question is only meant for the use of varient e).

In the above cases a)–d) which are of most interest, and where the reaction button 4 is pushed, the game master can immediately decide from the master monitor 2 if the reaction comes from the right participant.

The computer now "makes up" all accounts by adding the game prize to the balance of the winner, while all the others are held constant. If the game round continues to obtain further complete rows, the game now is carried on by a keyboard signal from the game master, and the game continues as previously described.

When the last section of a game round is finished and the last prize has been added to the account of a winner, all boards 6 are blanked out on the game monitors 3.

A new game round is then started by a new "sale of boards 6", for instance when a new game participant enters. Of course, a participant whose balance has fallen to zero, also may want to pay a new charge in order to continue to play. However, time is gained by letting several game participants pay for a number of games already from the start, and these participants are immediately ready to choose number of boards in a new game, as long as their balances cover this.

The more specific construction of the computer 1, including the video interfaces, will be obvious to a skilled person in this technical field when the previous statements have been drawn up, and constitutes no part of the present invention.

However, it is to be noted that the game monitors 3 and the master monitor 2 in the preferred and realized prototype version of the invention are colour TV monitors, but in principle one may, just as well as TV cathode ray tubes (CRT) use monitors of liquid crystal (LCD) type, plasma display devices or other suitable display devices.

Furthermore, it is of course possible to program the computer in such a manner that the prize to be gained in a game is related in a certain way to the total start charge paid in for that game. For instance a certain percentage may be used, say 70%, so that a total fee payment of 500 units (NOK) in one game, results in a prize of 350 units in that game. Figures of interests (percentage, paid charge, and prize) may then be presented on all of the game monitors 3 if it is desired.

I claim:

1. A bingo game computer system comprising:

a central computer unit;

a master monitor, operatively coupled to said central computer unit, including means for displaying selectable game data;

a master keyboard, operatively coupled to said central computer unit, including means for controlling and selecting the game data displayed on said master monitor;

a plurality of game monitors, operatively coupled to said central computer unit, each including a switch means operable by a game participant and each including means for displaying a plurality of bingo arrays which are each made up of a matrix of game squares and for displaying a game number, wherein said plurality of game monitors are provided in one-to-one correspondence with a number of game participants;

wherein said central computer unit includes (a) a first processor means for controlling a display of said master monitor and said plurality of game monitors, (b) a random number generator means for generating the game number to be displayed on said master monitor and said plurality of game monitors, and (c) a second processor means for causing an indicator to be displayed in a game square of each displayed bingo array which corresponds to the game number generated by said random number generator means.

2. A system as recited in claim 1, wherein said central computer unit further includes (a) means for causing each of said plurality of game monitors to display an account balance associated with each respective game monitor, the account balance denoting a difference between a fee paid by a game participant and a fee charged in connection with a number of bingo arrays displayed, and (b) means for adding to the account balance of each respective game monitor any prizes awarded.

3. A system as recited in claim 2, wherein said central computer unit includes means for causing said master monitor to display a game complete indication when a bingo result occurs on at least one of the bingo arrays displayed on said plurality of game monitors.

4. A system as recited in claim 3, wherein said central computer unit further includes means for prohibiting display on said master monitor and said plurality of game monitors of further game numbers generated by said random number generating means when the bingo result occurs on at least one of the bingo arrays displayed on said plurality of game monitors.

5. A system as recited in claim 3 or 4, wherein said central computer unit further includes means for causing each of said game monitors to display a game complete indication when a bingo result occurs on at least one of said bingo arrays displayed on said plurality of game monitors.

6. A system as recited in claim 3 or 4, wherein said central computer unit further includes means for causing a game complete indication to be displayed on only a game monitor in which a bingo result has occurred on at least one of said bingo arrays.

7. A system as recited in any one of claims 1–4, wherein said central computer unit further includes means, responsive to said switch means, for verifying that a bingo result has occurred on a bingo array of one of said plurality of game monitors, wherein a game participant activates said switch means when a bingo result is realized.

8. A system as recited in any one of claims 1–4, wherein said indicator is realized by blanking out each game square of each bingo array which corresponds to the game number generated by said random number generating means.

9. A system as recited in any one of claims 1–4, wherein said indicator is realized by at least one of (a) changing a display color of each game square of each bingo array which corresponds to the game number, and (b) providing a visible marker within each game square of each bingo array which corresponds to the game number.

10. A system as recited in any one of claims 1–4, wherein said master monitor and said plurality of game monitors are at least one of a CRT device, an LCD device and a plasma display device.

* * * * *